United States Patent [19]

Aguero

[11] 4,329,745

[45] May 18, 1982

[54] AUTOMATIC WEIGHT OPERATED TOILET FLUSHING DEVICE

[76] Inventor: Lazaro Aguero, 614 SW. 19th Ave., Miami, Fla. 33135

[21] Appl. No.: 179,766

[22] Filed: Aug. 20, 1980

[51] Int. Cl.[3] ..... E03D 5/04; H01H 13/52

[52] U.S. Cl. ..... 4/313; 4/250; 4/302; 4/305; 4/408; 200/160

[58] Field of Search ..... 4/300, 249, 302, 305, 4/313, 325, 409, 250, 408, DIG. 3, 330, 405, 411–414, 468; 200/160

[56] References Cited

U.S. PATENT DOCUMENTS

| | | | |
|---|---|---|---|
| 796,835 | 8/1905 | Fitzgerald | 4/408 |
| 920,928 | 5/1909 | Davis | 4/408 |
| 1,044,209 | 11/1912 | Luna | 4/408 |
| 1,135,028 | 4/1905 | Kreter | 4/408 |
| 1,676,550 | 7/1928 | Hanamann | 4/408 |
| 2,597,560 | 5/1952 | Beyrodt | 4/250 |
| 2,628,363 | 2/1953 | Stein | 4/408 |
| 2,649,591 | 8/1953 | McRae | 4/313 |
| 3,056,142 | 10/1962 | Chin | 4/408 |
| 3,334,359 | 8/1967 | Weingartner | 4/325 |

*Primary Examiner*—Stuart S. Levy
*Attorney, Agent, or Firm*—Jesus Sanchelima

[57] ABSTRACT

An automatic weight operated toilet flushing device capable of being installed in conventional toilets with flush tanks. The device has one end of a long arm secured to the lower portion of the toilet seat assembly the seat and the other end engages a vertical actuating link which is pushed upwardly when the toilet user seats down. The vertical link engages the actuating lever mechanism which is pulled down when the user gets up and the conventional ball type valve is opened allowing the toilet bowl to be flushed.

3 Claims, 6 Drawing Figures

AUTOMATIC WEIGHT OPERATED TOILET FLUSHING DEVICE

BACKGROUND OF THE INVENTION

1. Field of the Invention

This invention relates to automatic toilet flushers, and more particularly, to simple toilet flushers actuated by the user's weight capable of being easily installed with conventional ball type valve toilets.

2. Description of the Prior Art

The closest example of the prior art of which the applicant is aware correspond to U.S. Pat. No. 3,056,142 issued to Chin on Oct. 2, 1962. This patent claims and describes a mechanism by which a toilet is automatically flushed when the toilet seat is relieved from the weight of a person using it. Accordingly, a springloaded bell crank 14 is provided which brings the toilet seat back up towards the tank when the user stands up. This requires the user to hold the seat as he stands up to prevent a drastic movement and if the spring load is reduced, the mechanism might not be able to trigger its two cam assemblies 22 and 24. Chin's patent also differs from the present invention in the number of parts required.

Other patents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an automatic weight sensing flushing apparatus for conventional toilets without requiring a conspicuous lift of the toilet seat.

It is another object of the invention to provide in an automatic flushing toilet, means operable to control the flushing by sensing the weight of the user with a minimum of parts and cost.

Still another object of this invention is provide an automatic weight sensing toilet flushing device capable of being activated with a minimum of movement in the toilet seat assembly.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in details of construction and combination of parts as will be more fully understood from the following description, when read in conjuction with the accompanying drawings, in which.

DETAILED DESCRIPTION OF THE PREFERRED EMBODIMENT

Figure 1:
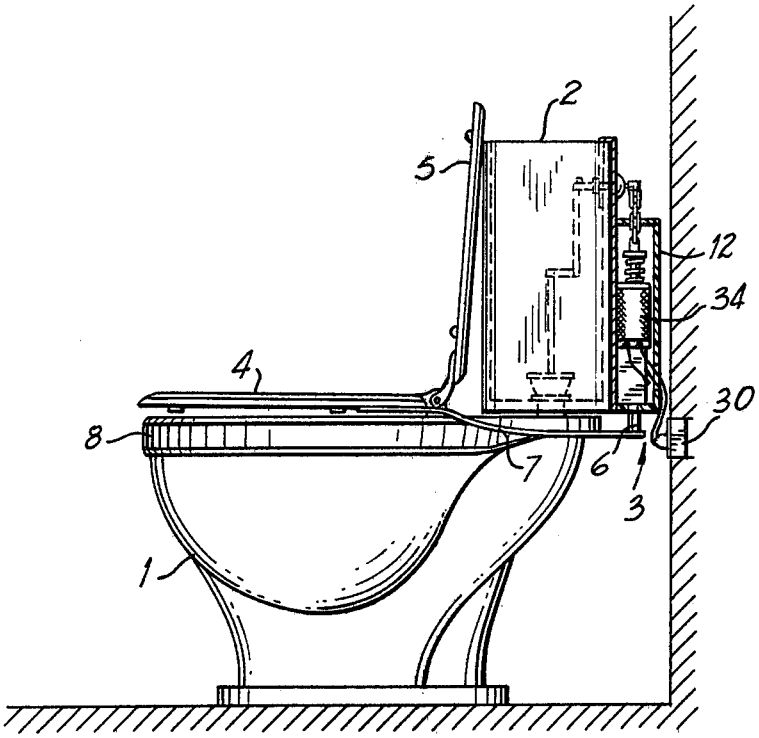
FIG. 1 is a side view of a conventional toilet using the electrical version of the present invention.

Referring to the drawing in detail, and particularly FIG. 1, a conventional water closet is illustrated including a toilet bowl 1, toilet seat 4, toilet cover 5 and water tank 2. The water tank 2 is usually seated on the rear of the toilet bowl 1 and above toilet rim 8.

Figure 5:
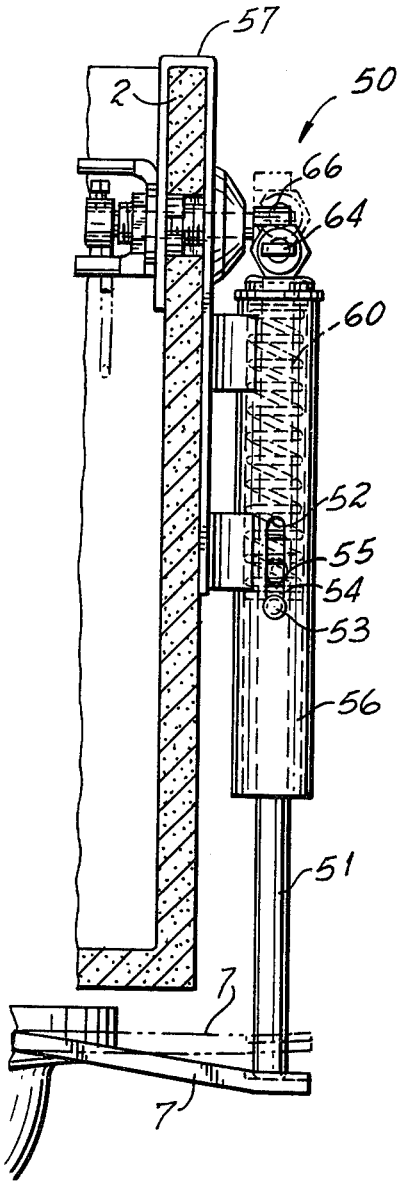
FIG. 5 illustrates a side view of the mechanical version of the device showing the raised position in phantom.
Figure 6:
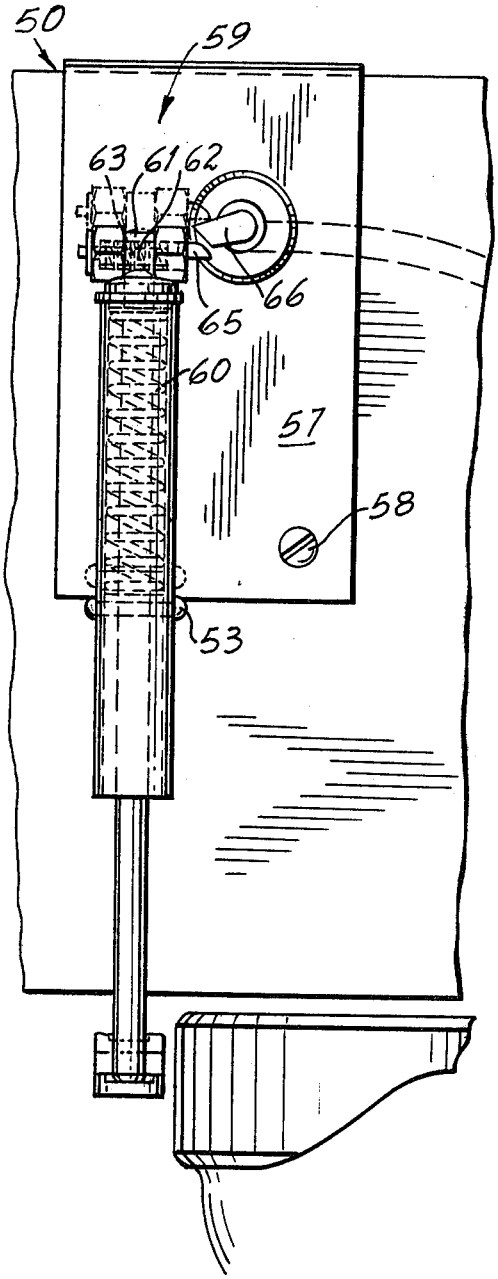
FIG. 6 illustrates a front view of the mechanical version of the device showing the raised position in phantom.

Basically, the overall operation of the invention is as follows, the housing 12 for the device is installed on the rear wall of the conventional toilet flush tank 2, as shown in FIG. 1, and a conventional lever assembly 37 similar to the one commonly found in toilets, and in some instances the same one can be used, is placed above the automatic flushing device 3. When the user sits down, toilet seat 4 moves pivotally downwardly a small angle until it is stopped by rim 8 of the toilet bowl 8. Arm 7 transmits the small movement to vertical link 6 which in turn activates the means for activating a conventional flush valve. This means for activating a conventional flush valve may be electrically or mechanically implemented. The electrical version 3 comprises switch and solenoid assemblies as means for activating the flush valve, as shown in FIGS. 1 through 4. The mechanical version 50 is directly operated by the weight of the user, as illustrated in FIGS. 5 and 6. Using either electrical or mechanical energy, this invention will detect and respond to the two possible positions of the seat: with the weight of the user on it or without it. The simplicity of installation for achieving reliably the desired result with a minimum manufacturing cost is an important need satisfied by the inventor.

Figure 2:
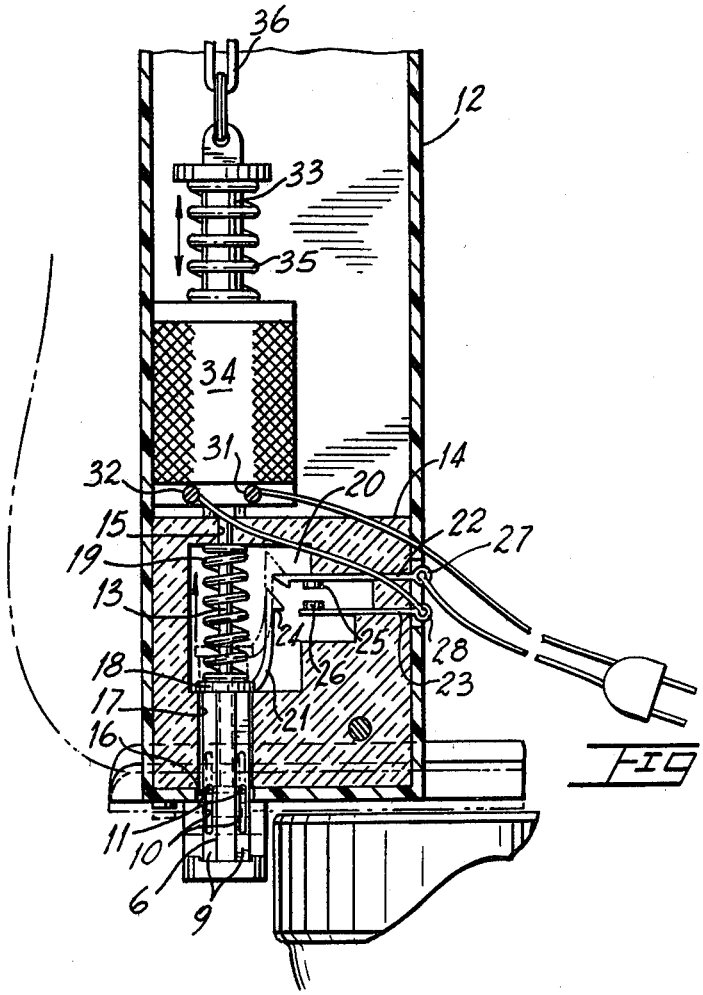
FIG. 2 illustrates a cross section of the switch assembly of the electrical version of the device.
Figure 3:
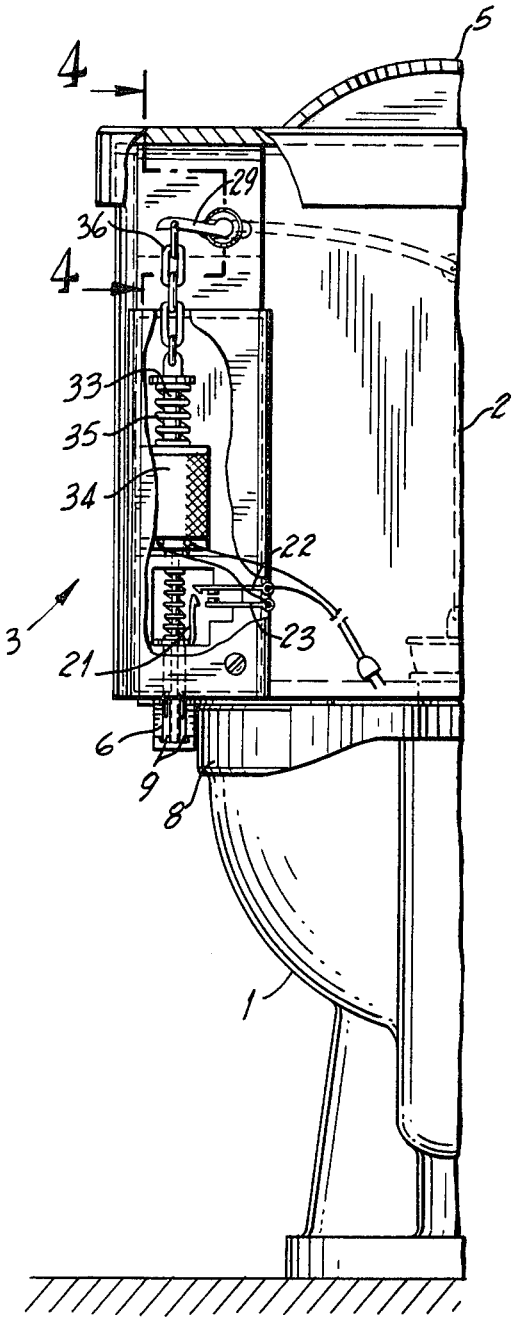
FIG. 3 shows a partial cross section of the switch assembly of the electrical version of the device installed in a conventional toilet.
Figure 4:
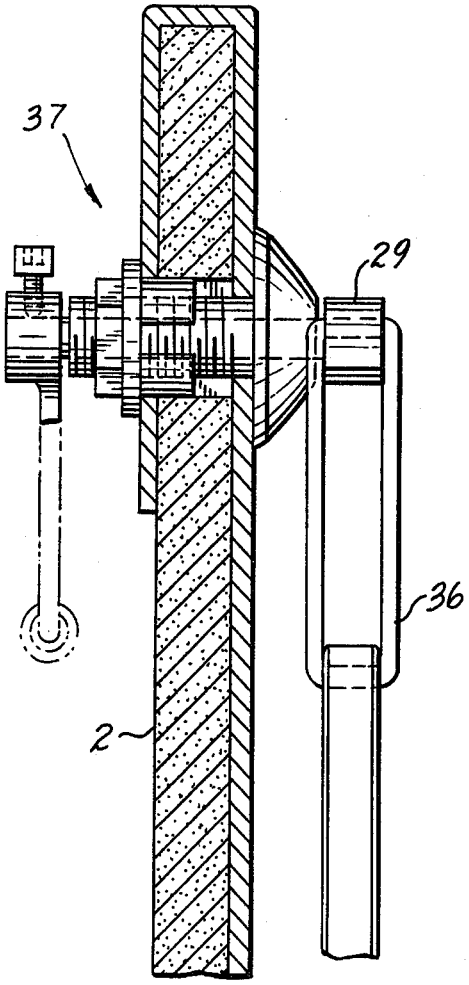
FIG. 4 shows the connection between the device and the conventional mechanism of the flush valve.

The toilet seat 4 and cover 5 are commonly hinged to said bowl 1. The automatic electric flushing device 3 is first described and the mechanical version will be described later. It is usually installed on the rear of water tank 2, concealed from the user's views. The device 3, in terms of broad inclusion, comprises a long arm 7 secured to the lower surface of toilet seat 4 on one end and the other end extending rearwardly below tank 2 engaging vertical actuating link 6 which is reciprocated by small pivotal movements of toilet seat 4 caused by the user's weight. Vertical actuating link 6, as shown in FIG. 2 of the preferred embodiment, consists of a hollow bar with square cross section and having lateral flanges 9 with slots 10. Link 6 is positioned through opening 16 and lower channel 17 of support body 14. These slots 10 receive guiding wires 11 which keep said vertical actuating link 6 in place. These guiding wires are positioned perpendicularly with said slots 10. Rod 13 is attached to support body 14 on its top surface by contact pressure through upper channel 15 and protrudes through cavity 20 into lower channel 17 where it is partially housed by the hollow bar spaces of link 6. The end of link 6 is terminated with cap 18 which biases spring 19 against the top surface of cavity 20 inside support body 14. Switch actuator 21 is attached to cap 18 and it has a cam surface that slides against the cam surface of upper leaf spring 22 when switch actuator 21 moves upwardly as a result of the user's weight being transmitted from toilet seat 4 to long arm 7 to link 6 and cap 18. Once the cam surface of switch actuator passes a certain point, the horizontal engaging surface 24 of said switch actuator 21 engages the upper surface of upper leaf spring 22. When the toilet seat 4 is relieved from the weight of a person using the toilet, actuator switch 21 will engage upper leaf spring 22 and start traveling downwardly until horizontal engaging surface 24 makes upper leaf spring 22 bend down far enough to make contacts 25 and 26 touch, closing the switch circuit. Switch actuator 21 will continue to travel downwardly until it disengages from the upper surface on the end of the upper leaf spring 22.

Upper and lower spring leaves 22 and 23 and switch actuator 21 are formed of flexible thin metal leaves and the relative separation among these elements is chosen in such a way that the above described operation is accomplished.

Eyelet terminal 27 is connected to the ground contact of outlet 30, thereby minimizing the possibility of an accidently shock through link 6. These considerations were made for the preferred embodiment because metalic parts were used for switch actuator 21, cap 18 and link 6. However, if these parts are made out of a nonconductive material that has similar flexibility characteristics, these potential problems would not be encountered.

Eyelet terminal 28 is connected to solenoid contact 31 and the other solenoid contact 32 is connected to the hot contact of outlet 30. Solenoid 34 may be any 110 volt solenoid capable of creating an electromagnetic field strong enough to offset the opposing bias of solenoid spring 35 wound around ferromagnetic headed shank 33. Chain 36 is connected to lever 29 which in turn activates the conventional mechanism for the flushing tank valve, which is commonly known. To install this automatic flushing device, a hole needs to be made through the upper rear wall of water tank 2 and a lever 29, with the standard associated mechanism, must be installed. This lever will work in a similar fashion to the one usually found in front of water tank 2.

The mechanical version of the present invention is illustrated in FIGS. 5 and 6, and referred to as automatic mechanical flushing device 50. The device 50 is installed in the same conventional toilets as the electrical version and it differs primarily in the means for actuating the flush valve since it is purely a mechanical dispositive and the electrical version utilizes a solenoid and a switch assembly. Referring to FIG. 5, it can be seen that the same long arm 7 is used to actuate vertical actuating member 51 which is provided with through opening 52 that houses spring biasing pin 53. Pin 53 protrudes through guiding slots 67 on tube 56, thereby helping to keep member 51 in place.

A tube 56, partially housing member 51, is rigidly attached to U-shaped bracket 57 which is installed in the back of water tank 2, as shown in FIG. 5. Bracket 57 is further secured in place by fastening means 58. Above pin 53 and around member 51, there is a metal washer 54 and a soft cushion washer 55. The latter is made of a soft material like rubber or leather. This pin and washers combination is urged downward by spring 60, thereby maintaining seat 4 slightly (about one-half of an inch) above the top surface of rim 8. Vertical actuating member 51 is provided with a cam assembly 59 mechanism on its upper end. The assembly 59 counteracts the biasing action of spring 60 against member 51. The cam assembly 59 consists of a housing 61, an actuating pin 62, a small spring 63 and a detainer 64. Actuating pin 62 is characterized by having a cammed head 65 which has the double function of activating lever 66 and biasing spring 60 against cam assembly housing 61 in order to allow actuating pin 62 is slide in and out as it is brought in contact with lever 66.

When the user's weight is applied to arm 7 and in turn member 51 moves upwardly, the bias of spring 60 is overcome and cam assembly 59 is displaced upwardly so that cammed head 65 passes the cam surface of lever 66. When the weight is relieved, cammed head 65 travels downwardly imparting a counterclockwise movement to lever 66 thereby activating the conventional flush valve.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. An automatic flushing device for toilets having a flush valve operable for releasing water from a flush tank to a toilet bowl provided with a seat hinged upon the bowl for pivotal movement around a horizontal axis at the rearward end of the seat, said device comprising, in operative combination:

(a) an elongated arm secured parallel to the bottom of said seat and extending rearwardly underneath and beyond said flush tank;

(b) a vertical link having one end perpendicularly engaged to the distal end of said arm and capable of reciprocating small pivotal movements of said seat caused by the weight of the user;

(c) a housing secured to said tank through which said link moves;

(d) means for spring biasing said link downwardly with respect to said housing thereby keeping said seat slightly raised from said toilet bowl as the spring bias is transmitted through said arm; and (e) means for actuating said flush valve responsive to the relative positions of said link comprising an electric solenoid mechanically coupled to said flush valve, switch means activated by the relative positions of said link, electric power means connected to said solenoid and interrupted by said switch means, wherein said link further comprises a flexible switch actuator secured to the upper end of said vertical link, wherein said switch means comprises a pair of flexible leaf springs provided with corresponding contacts and one of said springs being slightly longer than the other and provided with a cammed surface.

2. The device set forth in claim 1 further comprising means for guiding said link vertically.

3. The device set forth in claim 2 wherein said switch actuator has a cooperating cam surface to facilitate its deflection by said long switch leaf and a flat engaging surface underneath.

* * * * *